United States Patent [19]

Lampe et al.

[11] 3,998,623

[45] Dec. 21, 1976

[54] METHOD OF PRODUCING ALLOYS CONTAINING TITANIUM CARBIDE

[75] Inventors: Vaino Lampe; Bengt Sjoberg, both of Hagfors, Sweden

[73] Assignee: Uddeholms Aktiebolag, Hagfors, Sweden

[22] Filed: July 8, 1975

[21] Appl. No.: 594,009

[30] Foreign Application Priority Data

July 17, 1974 United Kingdom ..... 31754/74
Apr. 9, 1975 Sweden ..... 7504056

[52] U.S. Cl. ..... 75/10 R; 75/10 C; 75/129

[51] Int. Cl.[2] ..... C22B 4/06

[58] Field of Search ..... 75/10–12, 75/129, 130.5

[56] References Cited

FOREIGN PATENTS OR APPLICATIONS 1,150,459 4/1969 United Kingdom ..... 75/10 R

OTHER PUBLICATIONS

"ESR Alloys get the Call when Quality is a Must", Iron Age, Oct. 1974, pp. 39–43.

*Primary Examiner*—Peter D. Rosenberg
*Attorney, Agent, or Firm*—Pierce, Scheffler & Parker

[57] ABSTRACT

Alloys based on iron, nickel or cobalt and containing titanium carbide are produced by melting techniques. A melt containing only one of the two elements of titanium carbide is combined with the other element and caused to solidify immediately thereafter so that the titanium carbide grains are prevented from growing or forming aggregates. The combination of carbon and titanium is brought about by adding titanium to a carbon-containing, titanium free melt or adding carbon to a titanium-containing, carbon free melt. The process may be carried out in equipment for electro-slag remelting.

5 Claims, 8 Drawing Figures

METHOD OF PRODUCING ALLOYS CONTAINING TITANIUM CARBIDE

This invention relates to the production of alloys containing titanium carbide, and more particularly to alloys based on iron, cobalt or nickel and containing at least 0.6 percent by weight of titanium carbide.

British Patent Specification No. 1,339,420 describes the production by melting techniques of alloys containing titanium carbide in a matrix based on one or more metals selected from the group consisting of iron, nickel and cobalt. The alloys which are produced by the methods described in the just-mentioned specification are alternatives to the class of alloys produced by powder metallurgical methods which are commercially available under the name Ferro-TiC. These alloys are quite suitable for parts requiring high wear resistance and for various tools, such as punching, cold upsetting, and drawing tools. Apart from Ferro-TiC, titanium carbide also appears in hard metal, which, like Ferro-TiC, is produced by powder metallurgical techniques.

As stated in the above mentioned patent specification, the powder metallurgical method used in the production of Ferro-TiC is subject to certain limitations and disadvantages which can be eliminated by using melting techniques. One object of the invention described in the above-mentioned specification was to provide a process for producing materials of the Ferro-TiC type using melting techniques.

The methods described in the above-mentioned specification involve the combination of titanium carbide in powder form with the molten binder or matrix metal. However, the low density of the titanium carbide in relation to the density of the matrix metal creates problems as the titanium grains have a tendency to move up towards the surface of the molten matrix metal and to form dendritic aggregates during solidification of the matrix metal. It is furthermore difficult to effect the necessary wetting of the titanium carbide grains by the matrix metal.

To overcome this problem, it has been proposed to form a layer of the titanium carbide powder in a crucible or similar vessel and place the matrix metal in the form of small chunks or granules on top of the powder layer and then melt the matrix metal by induction or in other ways in vacuo so that it infiltrates the powder layer. The titanium carbide powder is subsequently distributed in the melted matrix metal by stirring.

According to a further proposal, the titanium carbide is added as an ingredient of a master alloy. This master alloy is produced by powder metallurgy by sintering in vacuo. In one case, the master alloy is added in air to the matrix alloy in granular form. In another case, an electro-slag remelting process is used in which the electrode to be consumed is made of the matrix alloy which is melted down together with one or more bars of the master alloy. The latter process can provide a finished alloy with good properties, but the need first to make the master alloy makes the process relatively costly.

The basic concept of the present invention is to have a melt which, within practical limitations, is free from one of the elements of titanium carbide, that is, either free from elementary titanium or free from elementary carbon, and to bring the other of these elements together with the melt immediately prior to solidification thereof, so that the titanium carbide is formed at as late a stage as possible. If the solidification occurs too long after the bringing together of the titanium and carbon, then the titanium carbide grains in the finished alloy become too large. Thus there is a relationship between (a) the time elapsing between the bringing together of the titanium and carbon and the solidification, and (b) the size of the titanium carbide grains, and if the time is sufficiently short, the risk of excessive growth of the titanium carbide grains is reduced.

According to the invention, the solidification is caused to take place so shortly after the bringing together of the titanium and the carbon that the average grain size of the titanium carbide does not exceed 10 microns, preferably not exceed 8 microns and suitably not exceed 4 microns while not more than 4 percent of the number of titanium carbide grains should exceed 20 microns in average grain size in the finished alloy. In a preferred embodiment, not more than 2 percent of the number of titanium carbide grains exceed 15 microns in average grain size.

The combination of carbon and titanium to form titanium carbide grains in accordance with this invention can take place in various ways. One method involves first producing a titanium rich, substantially carbon free melt (maximum 0.03 – 0.04% by weight carbon) to which carbon is added when tapping the melt into an ingot mould or other mould. As will appear in more detail as the description proceeds, it is also possible to use a melt containing the carbon and to add titanium to the melt. A further possibility is to pour simultaneously a substantially carbon free, titanium rich melt and a substantially titanium free, carbon rich melt into the same mould. This is advantageous if melting and casting take place in vacuo or in an inert atmosphere.

The procedures outlined above can also be carried out in practice in a continuous casting machine. In all cases, the proportion of carbon should be large enough so that it both meets the requirements for titanium carbide formation, and gives the desired carbon content in the matrix of the finished alloy.

If it is desired to produce the finished alloy in the form of ingots, the present invention is advantageously put into practice using electro slag remelting, i.e. continuous production of an ingot through electro thermic melting of one or more electrodes in a slag over a pool of molten metal, which continuously solidifies to form an ingot. In this way, at any given moment only a relatively small part of the material is present in molten state, which means that the period from the bringing together of the titanium and carbon to the time when the melt solidifies can easily be made relatively short so that the titanium carbide grains do not become too large and undesired titanium carbide aggregates are avoided.

The titanium carbide rich alloys and their uses are described fully in British Patent Specification No. 1,339,420 and the present invention is concerned with the production of titanium-containing alloys with a titanium carbide content of 0.6 to 35 percent by weight, preferably 1.3 to 15 percent by weight of titanium carbide.

In order that the invention may be more fully understood reference will now be made to the accompanying drawings.

Figure 1:
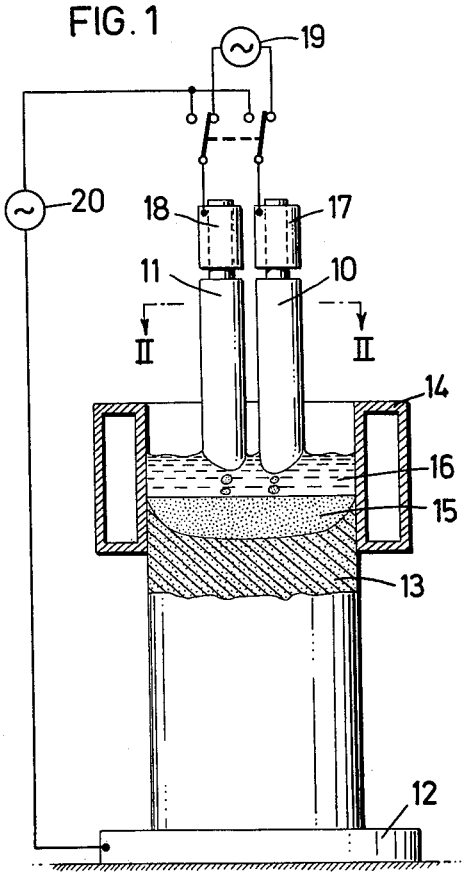
FIG. 1 shows schematically, partly in vertical section, a device for carrying out the method according to the invention using two consumption electrodes, one being titanium rich and practically free from carbon, and the other being carbon rich and practically free from titanium.

In the device shown in FIG. 1 consumption electrodes 10 and 11 are located over a bottom plate 12 which supports the continually upward growing ingot 13, the upper part of which, positioned in a water-cooled ingot mould 14, forms a pool 15 of liquid metal which is covered by a slag bath 16. The lower ends of the consumption electrodes 10 and 11 dip down into the liquid slag and continuously melt down under the influence of the resistive heat which is developed in the slag bath 16. The current developing this resistive heat is supplied to the consumption electrodes 10 and 11 through connectors 17 and 18, either from a current source 19, in which case the electrodes are connected in series, or from a current source 20 in which case the electrodes are connected in parallel to one pole of the current source 20 and the other pole is connected to the bottom plate 12 so that the ingot 13 completes the electrical circuit. In whichever of these methods is chosen the melted material from each electrode will separately fall through the slag bath 16 down into the pool 15, which solidifies from below at the rate at which newly melted material from the electrodes is supplied through the slag bath. The drops falling from one electrode therefore do not come in contact with the drops falling from the other electrode during the passage through the slag bath, and mixing only takes place in the pool 15.

Figure 2:
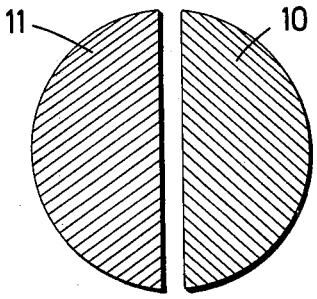
FIG. 2 is an enlarged sectional view along the line II—II in FIG. 1 of the consumption electrodes.

As is shown in FIGS. 1 and 2, the consumption electrodes 10 and 11 are practically alike in form and dimension; they are substantially semi-circular in cross section and spaced apart by a small distance.

Electrode 10 is made of a material which has a titanium content determined by the desired content of titanium carbide in the finished ingot 13 but is practically free of carbon, which means that the carbon content must be as low as practically possible, due consideration being given to cost and yield. Electrode 11 is substantially titanium free but contains carbon in an amount which corresponds to the desired carbon content in the finished ingot. The other components in the electrodes 10 and 11 determined the composition of the binder or matrix of the finished ingot 13 in which the titanium carbide grains are embedded.

The composition of typical electrodes 10 and 11 and of the finished ingot 13 is set out in Table 1 below in which the percentage figures are by weight.

TABLE 1

| Ingredient | Electrode 10 (containing titanium) | Electrode 11 (containing carbon) | Finished ingot 13 | | |
|---|---|---|---|---|---|
| | | | Upper end | Halfway between ends | Lower end |
| C | 0.25 | 3.82 | 2.21 | 2.13 | 2.00 |
| Si | 0.64 | 1.44 | 1.07 | 1.04 | 1.01 |
| Mn | 0.24 | 0.22 | 0.25 | 0.25 | 0.26 |
| P | 0.013 | 0.007 | 0.010 | 0.011 | 0.012 |
| S | 0.005 | 0.004 | 0.007 | 0.004 | 0.007 |
| Cr | 25.2 | & — | 12.1 | 12.0 | 11.6 |
| Mo | 1.60 | — | 0.84 | 0.84 | 0.78 |
| V | 1.78 | — | 0.88 | 0.84 | 0.83 |
| Ti | 4.8 | — | 2.5 | 2.4 | 2.4 |
| Al | 0.88 | — | 0.58 | 0.59 | 0.68 |
| Fe | & balance | balance | & balance | & balance | & balance |

In the three columns of Table 1 which set forth the composition of the ingot at the ends and halfway between the ends, each percentage figure is the arithmetic average of figures obtained at three positions on a cross section of the ingot, namely at a point near the circumference which, during the ingot production at the same side as electrode 10 (farthest to right in FIG. 1), a point near the circumference diametrically opposite the first-mentioned point, and at a point at the center of the ingot. The figures for the three positions vary somewhat from each other, but the differences are comparatively small; movements in the pool 15 and the slag bath 16 give a fairly even distribution of the various alloy components.

Examination of ingots of 120 mm diameter produced by means of the device shown in FIG. 1 showed that the average size of the titanium carbide grains was below 10 microns. The average value over a series of three ingots produced from electrodes of the compositions given in Table 1 was 8 microns, and one of these ingots had an average grain size of about 14 microns. In the last-mentioned ingot not more than 2 percent of the titanium carbide grains had an average size more than 15 microns. In the ingot having the largest titanium carbide grains, less than 4 percent of the titanium carbide grains were 20 microns or more in size. The testing of all ingots was made prior to subsequent plastic working or other treatment of the ingots.

The size of the titanium carbide grains in the ingots produced by means of the device shown in FIG. 1 can be controlled to some extent by controlling the amperage of the current supplied through the electrodes, the rate at which the electrodes are melted, the cooling of the mould and other parameters affecting the time elapsing between the bringing together of the carbon and titanium and the solidification of the melt. In order that the average size of the titanium carbide grains may not exceed the maximum value that is normally acceptable, this time should be ten minutes or less. In the process illustrated in FIG. 1 the solidification time is considerably shorter, normally between two and four minutes. Depending on the intended use of the alloy, solidification times longer than ten minutes may also result in acceptable average grain sizes and grain size distributions.

The carbon content given in Table 1 is the total carbon content; this means that a part of the indicated carbon content is the quantity of carbon which is combined with the titanium in the titanium carbide. The indicated titanium content of about 2.5 percent by weight corresponds to a titanium carbide content of about 3.1 percent by weight.

When carrying out the method of the invention using the apparatus shown in FIG. 1, the upper limit of the titanium carbide content in the ingot is, in practice, controlled by the fact that the carbon-containing electrode 11 cannot have more than a certain limited content of carbon if it is to have sufficient mechanical strength. A carbon content higher than 5–6% is hardly realistic in the case of an electrode made of pig iron, which means, in practice, that the total carbon content of the finished ingot will not normally be greater than 2.5 – 3 percent by weight, since the carbon-containing electrode contributes to approximately half of the total ingot weight.

Figure 3:
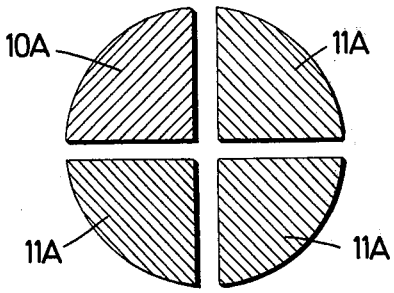
FIG. 3 is a sectional view, similar to FIG. 2, showing another arrangement of consumption electrode.

To increase the total carbon content of the ingot, i.e. to increase the titanium carbide content, one can use more than two electrodes, all having the same cross-sectional area, only one of the electrodes containing titanium, while the others all have the maximum possible content of carbon. The carbon-containing electrodes will, of course, contribute a considerably greater portion of the total ingot weight than the titanium-containing electrode. An example of such an electrode arrangement is shown in FIG. 3. In this case, four consumption electrodes of practically the same shape are used; a titanium-containing electrode 10A and three carbon-containing electrodes 11A.

Figure 4:
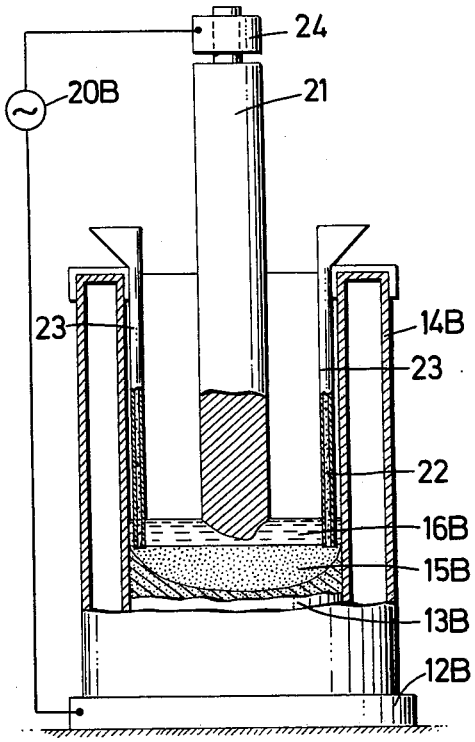
FIG. 4 shows schematically, partly in vertical section, a device for carrying out the method of the invention using only one consumption electrode and a separate supply of carbon in elementary form.

FIG. 4 shows another device for carrying out the invention. This device differs from that shown in FIG. 1 essentially in that it has only one electrode, a titanium-containing, substantially carbon free electrode 21 and the carbon 22 is supplied from pipes 23 supported by the ingot mould 14B. The device includes a bottom plate 12B supporting the continually upward growing ingot. 13B positioned in the water cooled mould 14B. The molten upper part of the ingot 13B forms a pool 15B covered by a slag bath 16B. Electrode 21 is connected via a connector 24 to one pole of a current source 20B, the second pole of which is connected to bottom plate 12B. The carbon supply pipes 23 extend through the slag bath 16B to the pool 15B and the carbon 22, which can be in the form of powder or bars in the pipes 23, is continuously supplied to the pool 15B as the pipes melt and the surface of pool 15B rises.

The present invention is advantageously applicable to the production of grinding discs for refiners of the type used for producing or mechanically processing wood pulp and similar fiber materials.

Grinding discs have to satisfy various requirements which are conflicting and which have been difficult or even impossible to meet in one and the same grinding disc using the customary materials. For example, the grinding discs should maintain an excellent and uniform grinding action to be able to produce pulp of uniform and high quality throughout their life. Moreover, they should have high resistance to wear, that is, long life and high impact strength to be able to resist the impact loads to which they may be subjected even in normal operation. A further desired quality is high resistance to corrosion and erosion. The material from which the grinding discs is produced should have good castability so that the discs can be cast in complicated shapes, and naturally should not be too expensive in relation to the properties of the finished discs.

A requirement related to the above-mentioned requirement for an excellent and lasting grinding action is that the discs should be self-sharpening. This means that the surfaces contacting the pulp or other fiber material during the processing must not be polished too well by the material, but retain a certain limited roughness.

Figure 5:
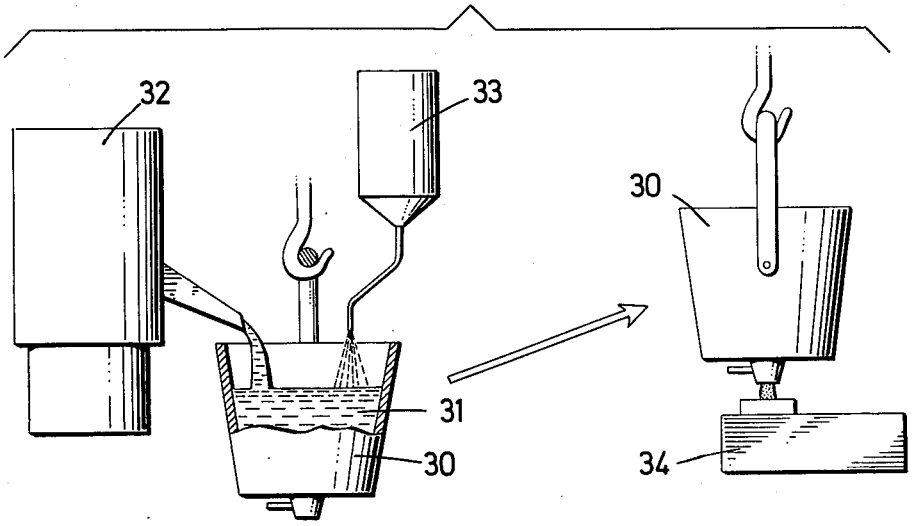
FIG. 5 is a diagrammatic view, partly in vertical section, illustrating another method embodying the invention.
Figure 6:
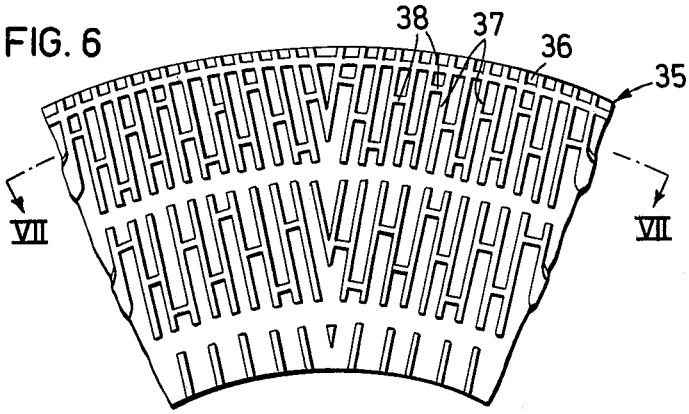
FIG. 6 is an elevational view of a grinding disc segment produced by the method illustrated in FIG. 5.
Figure 7:
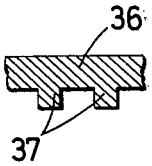
FIG. 7 is a fragmentary sectional view on line VII—VII of FIG. 6.
Figure 8:
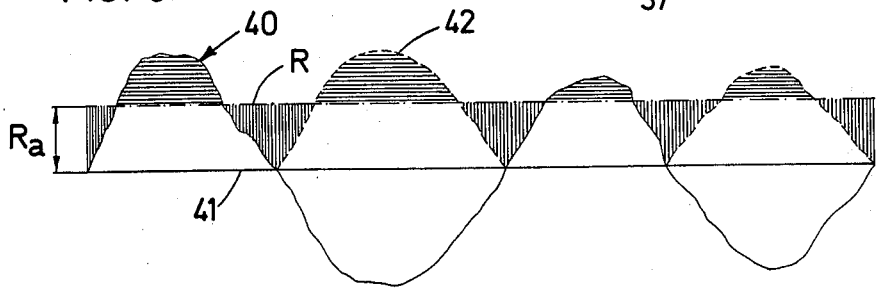
FIG. 8 is a diagram illustrating an essential characteristic of grinding disc segments.

FIG. 5 is a diagrammatic illustration of an embodiment of the method according to the invention by which grinding discs meeting the above-mentioned requirements can be produced. FIGS. 6 and 7 show a grinding disc segment produced by the method shown in FIG. 5 and FIG. 8 is a diagram serving to define a surface finish factor of the grinding disc segment.

Referring first to FIG. 5, there is shown a ladle 30 containing a melt 31 tapped from a cupola furnace 32. Apart from the titanium and a small amount of iron, the composition of the melt 31 corresponds to the composition of the finished segment. Titanium in the form of granulated ferrotitanium (70 percent of titanium and 30 percent of iron) supplied from a container 33 is added to the melt 31 in a quantity corresponding to the desired titanium content of the finished segment.

Immediately after the ferro-titanium has been added to the melt 31 and throughly mixed therewith, the melt is poured into a shell mould 34 through the bottom of the ladle 30. The maximum time that can be permitted to elapse between the bringing together of the titanium and the carbon-containing melt in the ladle 30 and the solidification of the metal in the mould 34 may vary according to the particulars of each specific case. However, it should be as short as possible and in any case not longer than 30 minutes. In fact in many cases it will be necessary to make this time considerably shorter, and a general maximum time is about 15 minutes. After the case segment has been removed from the mould, it is subjected to heat treatment.

FIG. 6 shows the front side of a grinding disc segment 35, namely the side which in operation of the refiner is contacted by the pulp or other fiber material. This side forms one wall of the grinding gap of the refiner. The segment 35 is provided with openings (not shown) or other means for attaching it to a circular supporting disc. A plurality of segments 35 together form a grinding ring on the support disc. As shown, the grinding disc segment 35 comprises a flat plate 36 having on the front side thereof a plurality of substantially radial ridges 37 and transverse short webs 38 between the ridges. The ridges are integral with the plate and serve, in cooperation with the corresponding ridges of an opposing grinding disc or other part of the refiner, to process the pulp or fiber material in the grinding gap. It should be noted that the cross-section is relatively thin throughout the segment so that the solidification takes place relatively rapidly in the mould 34.

The surface finish factor illustrated in FIG. 8 is herein termed "average surface deviation" and is significant to the quality of the processed pump. This figure shows a greatly enlarged cross-sectional profile contour 40 of the front face of one of the ridges 37 in FIG. 6. The mean line 41 of the profile contour 40 is a straight line located such that the surface area between the line and the profile contour segments above the line is equal to the surface area between the line and the profile contour segments below the line. The segments of the profile contour below the mean line 41 are mirrored with respect to the mean line as shown in dash lines at 42 and for the purpose of defining the average surface deviation $R_a$ only the thus "rectified" profile contour is used.

The average surface deviation $R_a$ is herein defined as the distance between the mean line $R_a$ and a second straight line, designated R in FIG. 8, which is parallel to the mean line and located such that the surface area between this second line and the sections of the rectified profile contour located above it is equal to the surface are between the second line and the sections of the rectified profile contour located below it (these two surface areas are marked by horizontal and vertical shade lines in FIG. 8). Thus, the second line R may be regarded as the mean line of the rectified profile contour.

The titanium carbide content of the grinding disc segment 35 is in the range from about 1.8 to about 6 percent by weight, the preferred range being 1.8 to 4.4 percent. The best results have been obtained with a titanium carbide content of about 3 percent. Titanium carbide contents above about 6 percent make it difficult to avoid accumulations of titanium carbide grains and consequent fracture indications. Too high a titanium carbide content also reduces the self-sharpening action of the segment, because the average distance between the titanium carbide grains then becomes too small in relation to the diameter of the fibers. The fibers of wood-pulp normally have a diameter in the range of 15 to 30 microns, and for that reason the average distance between the individual grains should never be less than 15 microns, and preferably it should not be less than 30 microns. On the other hand, too large a distance between the grains also reduces the self-sharpening action, and for that reason the average distance should not exceed 100 microns. The average grain size should not exceed 10 microns, and preferably it should not exceed 8 microns. Moreover, not more than 4 percent of the grains should be larger than 20 microns.

The following Table 2 sets forth compositions of four alloys suitable for the segment 35. For some alloy components two percentage ranges are given, the narrower range being the preferred range. All percentage figures are by weight.

TABLE 2

| Alloy component | Alloy A | Alloy B | Alloy C | Alloy D |
|---|---|---|---|---|
| C | 0.9 – 1.8 | 0.4 – 1.3 | 0.4 – 1.2 | 1.3 – 2.2 |
| | 1.2 – 1.4 | 0.5 – 0.7 | 0.6 – 0.9 | 1.5 – 1.7 |
| Si | 0.3 – 0.5 | 0.3 – 0.5 | max. 0.4 | 0.5 – 0.7 |
| Mn | 0.6 – 1.0 | 0.6 – 1.0 | max. 0.4 | 0.9 – 1.3 |
| P | max. 0.03 | max. 0.03 | max. 0.03 | max. 0.03 |
| S | max. 0.02 | max. 0.02 | max. 0.02 | max. 0.02 |
| Cr | 0.8 – 5.0 | 10.0 – 15.0 | | 10.0 – 15.0 |
| | 0.8 – 1.2 | 12.0 – 14.0 | — | 11.5 – 13.5 |
| Ni | 2.5 – 8.0 | 4.0 – 12.0 | 12.0 – 20.0 | |
| | 3.5 – 4.5 | 7.0 – 9.0 | 17.5 – 19.5 | — |
| Mo | 1.5 – 5.0 | 1.0 – 3.5 | 3.0 – 6.0 | |
| | 2.5 – 3.5 | 1.5 – 2.5 | 4.5 – 5.3 | — |
| Ti | 1.5 – 5.0 | 1.5 – 5.0 | 1.5 – 5.0 | 1.5 – 5.0 |
| | 2.5 – 3.5 | 2.5 – 3.5 | 3.2 – 3.9 | 2.5 – 3.5 |
| Al | 0.06 – 0.2 | 0.5 – 2.5 | 0.03 – 0.3 | |
| | | 0.7 – 1.3 | 0.06 – 0.2 | — |
| Co | — | — | 7.0 – 10.0 | — |
| | | | 8.1 – 9.5 | |
| V | — | — | — | 0 – 1.5 |
| | | | | 0.6 – 1.0 |
| Fe and impurities | balance | balance | balance | balance |

Grinding discs produced according to the above-described method from alloys of the compositions set forth in Table 2 have been found to have, in addition to other desired characteristics, a suitable degree of incapability of becoming polished which, in terms of average surface deviation $R_a$, is from twice to more than four times that of a customary material for grinding discs (alloyed cast iron).

The following Table 3 sets forth three examples of alloys according to the present invention and the hardness and average surface deviation of grinding disc segments produced from these alloys. For comparison, the table also sets forth the corresponding data of a reference alloy of a type customarily used for grinding discs. Composition percentage figures are by weight.

TABLE 3

| Alloy component | Test alloy I | Test alloy II | Test alloy III | Reference alloy |
|---|---|---|---|---|
| C | 0.9 | 0.8 | 1.6 | 2.9 |
| Cr | 1 | & — | 12 | 2.0 |
| Ni | 4 | & 18 | & — | 5 |
| Mo | 3 | 5 | — | & — |
| Ti | 3 | 3.5 | & 3 | — |
| Co | & — | 9 | & — | — |
| V | — | & — | & 0.8 | — |
| Heat treatment | Ageing 560° C/3h | Ageing 480° C/4h | & Austenitization 1020° C/30 min. Annealing 250° C/2h twice | No heat treatment |
| Hardness after heat treatment $HR_C$ | & 57 | 52–56 | & 57 | & 54 |
| Average surface deviation $R_a$ microns | 0.57 | & 0.51 | 0.27 | 0.13 |

We claim:

1. Method of producing an iron, cobalt or nickel alloy containing at least 0.6 wt. % of titanium carbide wherein titanium and carbon are brought together in a melt of a matrix alloy and the melt is caused to solidify so shortly after the bringing together of the carbon and titanium therein that the average grain size of the resulting titanium carbide in the alloy does not exceed 10 microns and not more than 4 percent of the titanium carbide grains are of a grain size more than 20 microns in the alloy in which method a titanium-containing melt is formed by continuous electrothermic melting of a substantially carbon-free electrode containing titanium, in a mold having a slag bath covering the surface of the melt; simultaneously adding carbon to said melt; and continuously producing an ingot from the resulting carbon-containing melt by congealing the melt in a brief period not exceeding ten minutes.

2. A method defined in claim 1, wherein carbon in solid form is added to the melt out of contact with said slag cover and said electrode.

3. Method according to claim 1, wherein the carbon is added by mixing a carbon-containing, substantially titanium-free melt with the titanium-containing melt.

4. Method according to claim 1, wherein the carbon is supplied by continuous melting at least one carbon-containing electrode simultaneously with the melting of the titanium-containing electrode.

5. Method according to claim 4, wherein the carbon-containing electrode connected electrically in parallel with the titanium-containing electrode.

* * * * *

UNITED STATES PATENT OFFICE

CERTIFICATE OF CORRECTION

PATENT NO. : 3,998,623

DATED : December 21,1976

INVENTOR(S) : Vaino Lampe, et al

It is certified that error appears in the above-identified patent and that said Letters Patent are hereby corrected as shown below:

Claim 5 - line 2 before "connected" insert:

- is -

Signed and Sealed this

Twenty-second Day of March 1977

[SEAL]

*Attest:*

RUTH C. MASON
*Attesting Officer*

C. MARSHALL DANN
*Commissioner of Patents and Trademarks*